US008485718B2

(12) United States Patent
Lay

(10) Patent No.: US 8,485,718 B2
(45) Date of Patent: Jul. 16, 2013

(54) SECURE ELECTRONICS TIMER

(76) Inventor: Richard Lay, Marshall, TX (US)

( * ) Notice: Subject to any disclaimer, the term of this patent is extended or adjusted under 35 U.S.C. 154(b) by 265 days.

(21) Appl. No.: 12/958,490

(22) Filed: Dec. 2, 2010

(65) Prior Publication Data

US 2011/0128823 A1 Jun. 2, 2011

Related U.S. Application Data

(60) Provisional application No. 61/265,870, filed on Dec. 2, 2009.

(51) Int. Cl.
*H01R 13/44* (2006.01)
*G04B 37/12* (2006.01)

(52) U.S. Cl.
USPC ..... 368/286; 368/203

(58) Field of Classification Search
USPC ..... 368/203, 278, 286, 327; 439/131
See application file for complete search history.

(56) References Cited

U.S. PATENT DOCUMENTS

| | | | | |
|---|---|---|---|---|
| 3,833,779 | A * | 9/1974 | Leone | 200/33 R |
| 4,792,881 | A * | 12/1988 | Wilson et al. | 361/827 |
| 6,149,445 | A * | 11/2000 | Daddono | 439/133 |
| 6,519,208 | B2 | 2/2003 | DeVries | |
| 6,722,984 | B1 | 4/2004 | Sweeney, Jr. et al. | |
| 7,083,438 | B2 * | 8/2006 | Massaro et al. | 439/133 |
| 7,284,995 | B1 * | 10/2007 | Vail | 439/133 |
| 7,977,825 | B2 * | 7/2011 | Gilbert | 307/131 |
| 2005/0094786 | A1 | 5/2005 | Ossa | |
| 2007/0234380 | A1 | 10/2007 | Sahasrabudhe et al. | |
| 2007/0297112 | A1 * | 12/2007 | Gilbert | 361/91.5 |
| 2009/0102616 | A1 | 4/2009 | Stone et al. | |
| 2009/0142947 | A1 * | 6/2009 | Byrne | 439/131 |
| 2010/0317204 | A1 * | 12/2010 | Ryan | 439/133 |

* cited by examiner

*Primary Examiner* — Sean Kayes
(74) *Attorney, Agent, or Firm* — James Ray & Assoc.

(57) ABSTRACT

A lockable timing apparatus for multiple electronic devices includes an enclosure having a bottom, two side walls, an end wall, and a lid, with a door member opposing the end wall and hingedly attached to a side wall, the bottom, or the lid. At least one notch is in an exposed edge of at least one of the door member and the lid. Inside the enclosure are at least one electrical timer with a power supply cord, and at least two electrical outlets electrically connected to the at least one electrical timer. A locking means is disposed at least in part on the door member for denying unauthorized persons access to the electrical timer and the at least two electrical outlets.

6 Claims, 2 Drawing Sheets

SECURE ELECTRONICS TIMER

CROSS REFERENCE TO RELATED APPLICATION

This patent application is related to and claims priority from U.S. Provisional Patent Application Ser. No. 61/265,870 filed Dec. 2, 2009.

FIELD OF THE INVENTION

The present invention relates, in general, to parental control of children's access to electronic devices and, more particularly, this invention relates to an apparatus for locking a timer and multi-power outlet which limits a child's access to a limited amount of usage for electronic electrical devices.

BACKGROUND OF THE INVENTION

Prior to the conception and development of the present invention, children may have been verbally limited by their parents to a certain amount of usage time for electronic devices, but not in a way secured by the parents free from tampering by their children. Others have devised various ways to deal with this issue. DeVries in U.S. Pat. No. 6,519,208 teaches a locking timer and outlet cover, which enables single times to be locked with a padlock inside a box. The DeVries assembly suffers from the drawbacks that only one timer can be accommodated, and it must be mounted at a wall outlet, which may necessitate an unusually long cord to the electrical or electronic device. Extension cords would render the assembly useless, because then the electronic device could be unplugged and moved to another outlet with no timer.

Sweeney Jr, et al. in U.S. Pat. No. 6,722,984 discloses a controller for video games with parental controls wherein the timer is built into the game controller. This necessitates a specially designed and built controller which is likely to be prohibitively expensive.

U.S. Patent Application Publications numbered 2005/0094786, 2007/0234380, and 2009/0102616 all disclose an apparatus and/or method for time-based control of electrical or electronic devices. None teach use of multiple timers or ways to control multiple devices from a single unit.

SUMMARY OF THE INVENTION

The present invention provides a lockable timing apparatus for multiple electronic devices, and includes an enclosure having a bottom, two side walls, an end wall, and a lid, with a door member opposing the end wall and hingedly attached to a side wall, the bottom, or the lid. At least one notch is in an exposed edge of at least one of the door member and the lid. Inside the enclosure are at least one electrical timer with a power supply cord, and at least two electrical outlets electrically connected to the at least one electrical timer. A locking means is disposed at least in part on the door member for denying unauthorized persons access to the electrical timer and the at least two electrical outlets.

In an alternative embodiment, an enclosure with a hinged lid houses a power strip with at least two individual timers for controlling at least two electronic devices. After the devices are plugged in and the timers set, the lid can be closed and locked shut.

OBJECTS OF THE INVENTION

It is, therefore, one of the primary objects of the present invention to provide an apparatus to limit multiple children in their usage time for plug-in electronic and electrical devices.

Another object of the present invention is to provide a locking box with a secure internal timer, which can be used to limit a child's usage time to a set duration.

Still another object of the present invention is to provide multiple game players with a variable amount of playing time, which is controlled by the parents.

Yet another object of the present invention is to provide a flexible secure electronics timer apparatus which can be locked but also readily altered by parents for limiting the entertainment time of multiple children.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
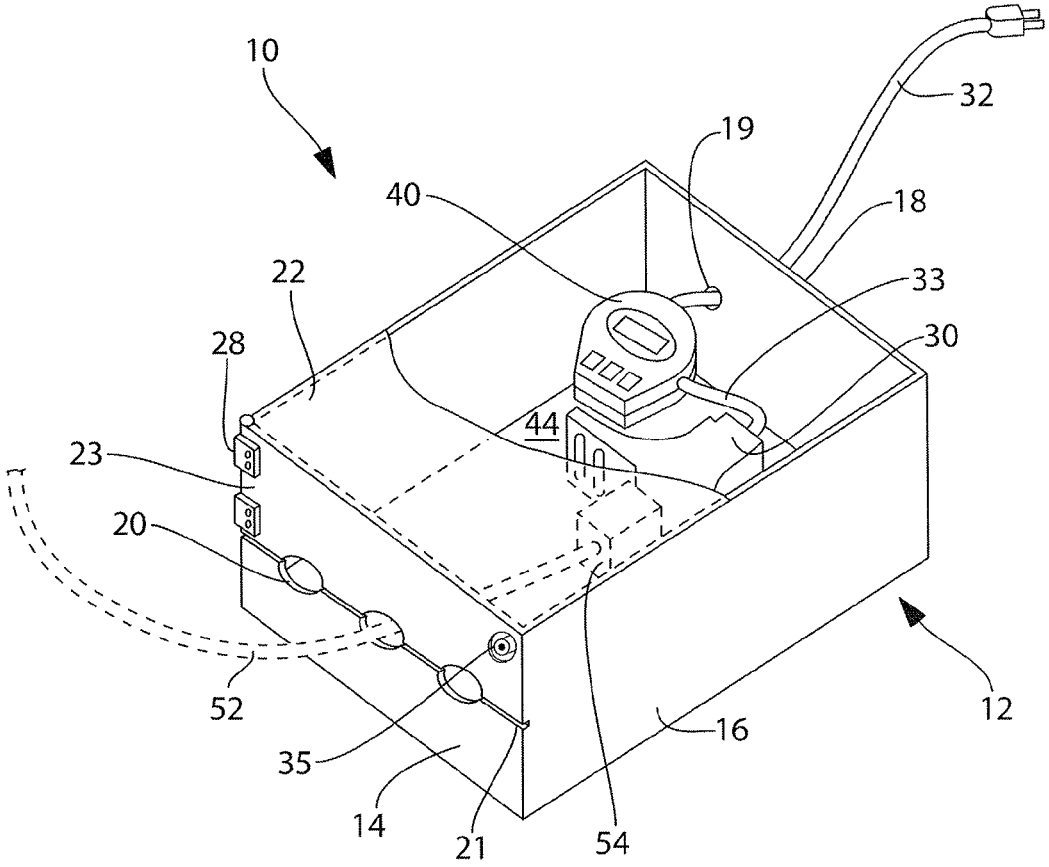
FIG. 1 is a partial cut-away perspective view of a preferred embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, a partial cut-away perspective view of a preferred embodiment of the present invention, generally indicated as 10, is shown. A box-like enclosure 12 is substantially closed on nearly all sides with two side walls 16, a back wall 18, a bottom 44, and a lid 22. Opposing the back wall 18 is at least one door member 23 at the other end, hingedly attached to a side wall 16 with at least one hinge 28. The door member 23 could alternatively be hingedly attached to the lid 22, or the bottom 44. Another end member 14 makes up a portion of that end enclosure. At least one of the end member or hinged member 23 has at least one notch 20 formed in an edge 21. The box 12 houses a timer 40 with a power cord 32 passing through the back wall 18, and a multi-outlet adaptor 30. The multi-outlet adaptor 30 can accommodate multiple plugs or transformers 54 for powering electrical devices via cords such as 52. The adaptor 30 connects to the timer with an electrical connection 33. The door member 23 can be swung open to plug in or unplug cords 52 fitting through notches 20. The door member 23 can be locked or unlocked with a locking means 35 on at least one of the hinged member 23, sidewall 16, and the lid 22.

Figure 2:
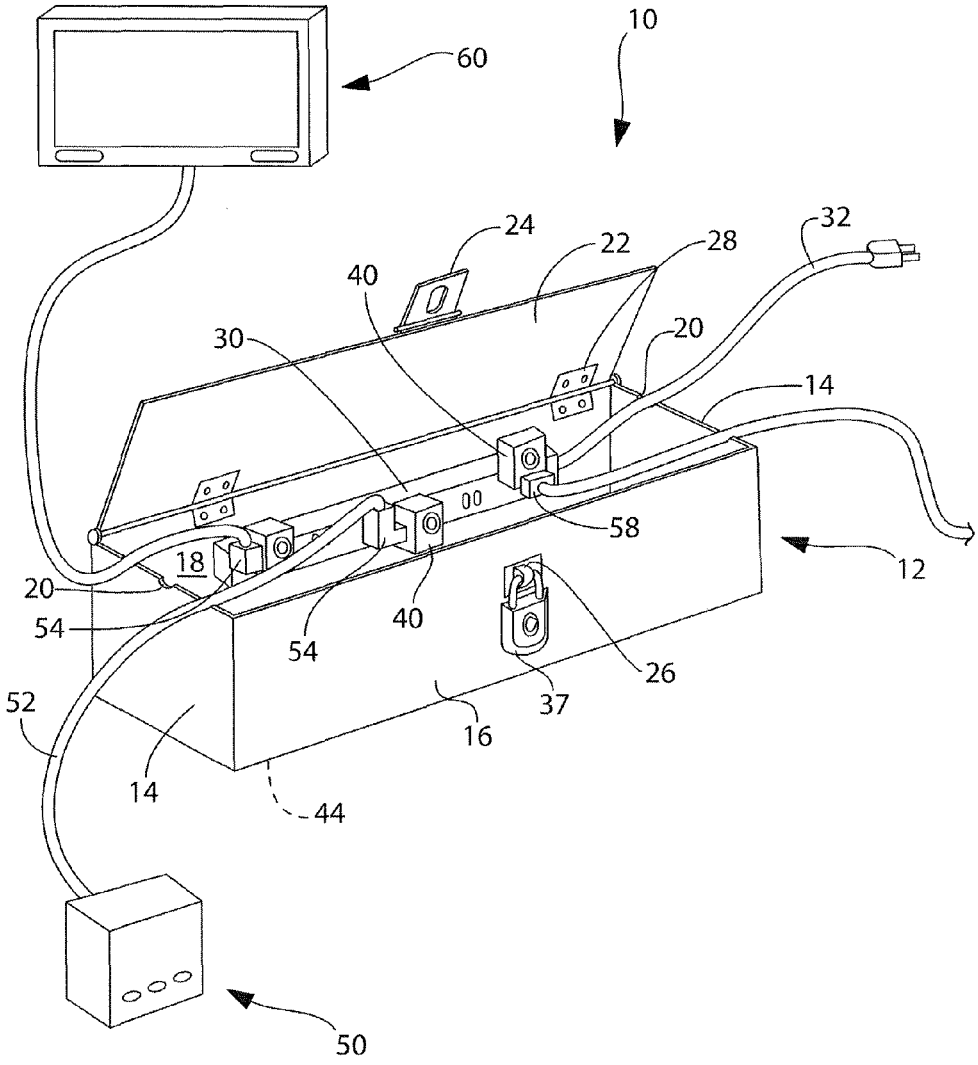
FIG. 2 provides a perspective view of an alternative embodiment of the present invention.

FIG. 2 provides a perspective view of an alternative embodiment of the present invention, generally shown as 10, and depicting how it can be used to limit electrical power supply to at least one of a game device 50 and a video device 60. The box enclosure 12 has a sidewall 16, two end members 14, a back wall 18, and a hinged lid 22. Not visible is the bottom 44 which need only restrict access into the box enclosure 12. Attached to either the back wall 18, bottom 44, or the sidewall 16 is a multi-outlet power strip 30. At least one electrical timer 40 plugs into the power strip 30, and standard plugs 58 or voltage adaptors 54 plug into the timers 40. The timers 40 may be either a programmable type or a countdown type, preferably three in number. Notches 20 in at least one of the end members 14 and/or sidewall 16 allow passage of the cords 52 to electronic devices such as 50 and 60. The lid 22 can be closed and locked into place by any of various locking means—shown is a loop 26 and slotted strap 24 for engaging a standard padlock 37. This allows parental control of access to the plugs and the timers to set time limits on how long the electrical devices can be used. In both embodiments, the box enclosure 12 may be constructed of any suitable material including wood, plastic, or metal.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A lockable timing apparatus for multiple electronic devices comprising:

a) an enclosure having a bottom, two side walls, first end wall closing one end of said enclosure, a second end wall partially closing an opposing end of said enclosure, and a lid;

b) a door member hingedly attached to one of said side wall, said bottom, and said lid, said door member configured to selectively open or close said partially open opposing end of said enclosure, whereby said second end wall and said door member define a pair of opposing edges spanning a length of each of said second end wall and said door member;

c) at least one notch in an exposed edge of at least one of said door member and/or said second end wall;

d) at least one electrical timer with a power supply cord connecting said at least one electrical timer with a power supply source and passing through an aperture in said first end wall;

e) a multi-outlet adaptor electrically connected by a cord to said at least one electrical timer; and f) a locking means disposed at least in part on said door member.

2. The lockable timing apparatus, according to claim 1, wherein said multi-outlet adaptor includes two sockets receiving electrical power from the power supply source through said at least one electrical timer.

3. The lockable timing apparatus, according to claim 1, wherein said locking means is a key and bolt type in a distal portion on said hingedly attached door member.

4. The lockable timing apparatus, according to claim 1, wherein said locking means is a padlock.

5. The timing apparatus of claim 1, wherein said multi-outlet adapter is configured to accommodate multiple plugs or voltage transformers.

6. The timing apparatus of claim 1, wherein said at least one electrical timer and said multi-outlet adaptor are so electrically connected therebetween that an electronic device plugged into said multi-outlet adaptor receives power from the power supply source through each of said at least one electrical timer and said multi-outlet adaptor.

* * * * *